US011602040B2

(12) United States Patent
Kotzian et al.

(10) Patent No.: US 11,602,040 B2
(45) Date of Patent: Mar. 7, 2023

(54) WAVEGUIDE INJECTING UNIT

(71) Applicant: Anton Paar GmbH, Graz (AT)

(72) Inventors: Heimo Kotzian, Graz (AT); Helmar Wiltsche, Graz (AT); Paul Finsterwalder, Seiersberg-Pirka (AT)

(73) Assignee: ANTON PAAR GMBH, Graz (AT)

( * ) Notice: Subject to any disclaimer, the term of this patent is extended or adjusted under 35 U.S.C. 154(b) by 0 days.

(21) Appl. No.: 17/323,973

(22) Filed: May 18, 2021

(65) Prior Publication Data

US 2021/0368611 A1 Nov. 25, 2021

(30) Foreign Application Priority Data

May 22, 2020 (AT) ..... A 50453/2020

(51) Int. Cl.
*H05H 1/46* (2006.01)
*H01J 49/10* (2006.01)

(52) U.S. Cl.
CPC ..... *H05H 1/463* (2021.05); *H01J 49/10* (2013.01)

(58) Field of Classification Search
None
See application file for complete search history.

(56) References Cited

U.S. PATENT DOCUMENTS 5,063,329 A * 11/1991 Okamoto ..... H01J 37/32229 315/39
5,086,255 A * 2/1992 Okamoto ..... H01J 49/105 315/111.21
5,308,977 A * 5/1994 Oishi ..... H01J 49/105 250/281

(Continued)

FOREIGN PATENT DOCUMENTS

AT 523626 A4 * 10/2021 ..... H01J 37/32192
DE 40 04 560 A1 8/1990

(Continued)

OTHER PUBLICATIONS

Wolff, Christian, "Magnetron," www.radartutorial.eu, 2018, 13 pages.

(Continued)

*Primary Examiner* — Srinivas Sathiraju
(74) *Attorney, Agent, or Firm* — Lewis Roca Rothgeber Christie LLP

(57) ABSTRACT

Described is an apparatus for guiding an electromagnetic microwave, having: antenna surrounding walls, which define an interior space so as to surround therein at least an end region of an antenna of a microwave source, in particular laterally annularly as well as frontally; waveguide boundary walls, at least two of which are arranged in parallel to each other, wherein the waveguide boundary walls form a, in particular cuboid-shaped, waveguide having a substantially rectangular cross-section, wherein a cross-sectional plane is defined by a first direction that extends along a longitudinal direction of the antenna and a second direction that extends perpendicularly to the first direction, wherein it holds: 25>a/b>3, wherein a: is a width of the waveguide along the second direction, b: is a height of the waveguide along the first direction, wherein the apparatus is designed to let proceed a microwave from the interior space of the antenna surrounding walls into the waveguide.

18 Claims, 4 Drawing Sheets

(56) References Cited

U.S. PATENT DOCUMENTS 5,471,115 A * 11/1995 Hikosaka ..... H01J 37/3299 315/111.41
5,565,118 A * 10/1996 Asquith ..... F23R 3/18 219/121.48
5,625,259 A * 4/1997 Holber ..... H05H 1/46 315/111.21
6,010,755 A * 1/2000 Suzuki ..... H01J 37/32678 315/111.41
6,057,645 A * 5/2000 Srivastava ..... H01J 37/32192 315/111.21
6,248,998 B1 * 6/2001 Okumoto ..... H01J 49/105 250/288
6,401,653 B1 * 6/2002 Taniguchi ..... H01J 37/32192 118/723 MR
6,614,000 B1 * 9/2003 Bessho ..... H05H 1/46 219/121.48
6,836,060 B2 * 12/2004 Hudak ..... G01N 30/64 219/121.49
7,005,635 B2 * 2/2006 Ahern ..... H01J 49/165 250/281
7,619,178 B2 * 11/2009 Peschel ..... H05H 1/46 219/121.48
7,696,474 B2 * 4/2010 Wu ..... G01N 27/624 250/281
8,003,935 B2 * 8/2011 Robinson ..... H01J 49/145 250/281
8,003,936 B2 * 8/2011 Robinson ..... H01J 49/145 250/281
8,334,505 B2 * 12/2012 Robinson ..... G01N 27/62 250/281
8,834,684 B2 * 9/2014 Proudkii ..... B01J 19/126 204/157.43
9,072,158 B2 * 6/2015 Ikeda ..... H01J 37/3222
9,129,778 B2 * 9/2015 Huseinovic ..... C23C 16/45565
9,295,968 B2 * 3/2016 Proudkii ..... B01J 19/10
9,520,272 B2 * 12/2016 Ikeda ..... H01J 37/32201
9,686,849 B2 * 6/2017 Morrisroe ..... H05H 1/42
9,691,591 B2 * 6/2017 Iwasaki ..... H01J 37/3222
9,972,476 B2 * 5/2018 Taki ..... C23C 16/26
9,987,611 B1 * 6/2018 Strohm ..... C01B 32/205
10,327,321 B2 * 6/2019 Hammer ..... H05H 1/461
10,601,125 B2 * 3/2020 Cohen ..... H01Q 1/366
11,244,810 B2 * 2/2022 Mori ..... H01J 37/32293
2002/0063530 A1 * 5/2002 Ikeda ..... H05H 1/4622 315/111.21
2003/0000823 A1 * 1/2003 Uhm ..... H05H 1/30 204/157.43
2004/0233944 A1 * 11/2004 Dantus ..... G01B 9/02014 372/25
2005/0078309 A1 * 4/2005 Hammer ..... H05H 1/30 356/316
2005/0163696 A1 * 7/2005 Uhm ..... H05H 1/30 423/445 B
2007/0007257 A1 * 1/2007 Uhm ..... H05H 1/30 219/121.48
2012/0090782 A1 * 4/2012 Ikeda ..... H01J 37/32293 156/345.28
2012/0299671 A1 * 11/2012 Ikeda ..... H05H 1/46 333/248
2013/0020939 A1 * 1/2013 Kim ..... H01P 3/123 315/111.41
2014/0361684 A1 * 12/2014 Ikeda ..... H01J 37/32229 315/34
2015/0255258 A1 * 9/2015 Nozawa ..... C23C 16/4584 118/723 MW
2016/0013023 A1 * 1/2016 Taki ..... H05H 1/46 427/575
2017/0095787 A1 * 4/2017 Hong ..... H05H 1/30
2017/0179587 A1 * 6/2017 Cohen ..... H01Q 9/005
2018/0228012 A1 * 8/2018 Hammer ..... G01J 3/443
2019/0159329 A1 * 5/2019 Reske ..... H05H 1/46
2019/0186369 A1 * 6/2019 Lowery ..... F23R 3/002
2019/0186437 A1 * 6/2019 Lowery ..... F02M 27/06
2019/0186438 A1 * 6/2019 Lowery ..... H05H 1/2406
2019/0368422 A1 * 12/2019 Lowery ..... H01Q 1/44
2020/0365371 A1 * 11/2020 Mori ..... H05H 1/46
2021/0368611 A1 * 11/2021 Kotzian ..... H05H 1/30

FOREIGN PATENT DOCUMENTS

DE 40 28 525 A1 3/1991
DE 199 82 291 C2 7/2001
ES 2556231 T3 * 1/2016 ..... A61B 18/042
WO WO 2008/151335 A1 12/2008
WO WO 2011/058921 A1 5/2011
WO WO 2011/147230 A1 12/2011
WO WO-2016014790 A1 * 1/2016 ..... H01Q 1/366

OTHER PUBLICATIONS

Search Report for corresponding AT Application A 50453/2020, dated Mar. 24, 2021, 1pg.
Office action for corresponding AT Application A 50453/2020, dated Mar. 24, 2021, 3pp.
Search Report of corresponding AU Application A50453/2020, dated Mar. 24, 2021, 1 page.
Office Action of corresponding AU Application A50453/2020, dated Mar. 24, 2021, 3 pages.
Wolff, "Magnetron," www.radartutorial.eu, 2018, 7 pages.

* cited by examiner

WAVEGUIDE INJECTING UNIT

CROSS-REFERENCE TO RELATED APPLICATIONS

The present application is a follow-up application to, and claims the benefit of the priority date of, Austrian Patent Application No. A 50453/2020, filed May 22, 2020, which is incorporated herein by reference in its entirety.

TECHNICAL FIELD

The present disclosure relates to an apparatus for guiding an electromagnetic microwave, which is in particular designed to induce a plasma by the microwave guided in the waveguide, for example in order to spectroscopically examine a sample. The present disclosure further relates to a method of guiding an electromagnetic microwave.

BACKGROUND OF THE DISCLOSURE

DE 4028525 A1 discloses a microwave plasma source device having a combination of a planar waveguide and a cylindrical coaxial waveguide. Herein, microwave power is efficiently supplied to a body of a discharge plasma, which is generated inside a discharge tube that is disposed along the centre axis of an inner conductor of the cylindrical coaxial waveguide.

DE 4004560 A1 discloses microwave-induced plasma sources having a coaxial waveguide formed of a cylindrical outer conductor and an inner conductor, wherein the inner conductor is formed of a spiral coil, wherein a discharge tube, which has a double tube structure and is inserted into the spiral coil in the axial direction thereof, is provided.

U.S. 2003/000823 A1 discloses an emission control system for burning gas compounds using a microwave plasma torch. An oxidation mechanism in the plasma flame eliminates contaminants.

U.S. 2005/163696 A1 discloses a synthesis of carbon nanotubes. In this process, a mass synthesis of carbon nanotubes is carried out in a gas phase, wherein a microwave plasma torch at atmospheric pressure is used.

U.S. 2007/007257 A1 discloses a microwave plasma burner, wherein a high temperature plasma flame is generated by an injection of gaseous, liquid or solid-powdery hydrocarbons into a plasma, which is generated by microwaves.

U.S. 2017/095787 A1 discloses a microwave plasma torch, wherein a plasma generator, a microwave generator and at least one plasma source gas injector are provided. Herein, the microwave generator has a waveguide and the plasma generator has a discharge tube, wherein the discharge tube enters through a waveguide perpendicular to the waveguide.

WO 2011/147230 A1 discloses a microwave plasma igniter having a microwave resonant cavity, a quartz glass tube, a tangential air supply device, and a flow device for pulverized coal, wherein a region of greatest microwave field intensity within the quartz glass tube forms a microwave plasma generation region, into which a pulverized coal flow is axially guided by the coal flow device.

The prior art thus discloses relatively complex and bulky equipments for guiding a microwave from a microwave source to, for example, a microwave applicator, in which the microwave is used, for example, to generate ionized sample atoms or sample molecules in order to investigate the sample spectroscopically.

There may be need to propose an apparatus for guiding an electromagnetic microwave, which is in particular suitable to guide (in particular embodiments) the microwave to a plasma generation region (e.g. within a cylindrical waveguide) so as to ionize a sample for spectroscopic examination, wherein the complexity and the size of the apparatus is simplified and/or reduced, respectively, in comparison to the prior art. Furthermore, there may be a need to provide a microwave applicator, which has a more compact dimension.

SUMMARY OF THE DISCLOSURE

These needs are met by the subjects of the independent claims. Advantageous embodiments of the present disclosure are specified in the dependent claims.

According to an exemplary embodiment of the present disclosure, there is provided an apparatus for guiding an electromagnetic microwave, having: antenna surrounding walls (or antenna enclosing walls), which define an interior space for surrounding (or enclosing) therein at least an end region of an antenna of a microwave source, in particular laterally annularly as well as frontally; waveguide boundary walls (or waveguide delimitation walls), at least two of which are arranged in parallel to each other, wherein the waveguide boundary walls form a, in particular cuboid-shaped, waveguide, which has a substantially rectangular cross-section, wherein a cross-sectional plane is defined by a first direction that extends along a longitudinal direction of the antenna and a second direction that extends perpendicularly to said first direction, wherein it holds: $25>a/b>3$, wherein a: is a width of the waveguide along the second direction, b: is a height of the waveguide along the first direction, wherein the apparatus is designed to let proceed a microwave from the interior space of the antenna surrounding walls into the waveguide.

In the context of the present application, the apparatus may also be referred to as a waveguide injecting unit and/or a waveguide coupling-in unit. The waveguide injecting unit may also be referred to as a "launcher". The apparatus may in particular be suitable to guide the microwave to a microwave applicator, wherein further components may be provided. For example, the microwave may have a frequency of from 1 GHz to 300 GHz, corresponding to a wavelength of about 1 mm to 30 cm.

The microwave applicator may, for example, be designed to ionize a sample to be examined by the plasma guided in the apparatus, in order to be able to subsequently examine it spectroscopically, e.g. with regard to composition, concentration, etc. In a microwave applicator, which may further be included in the apparatus, the microwave may be used to generate a plasma for electronic excitation of sample molecules and/or sample atoms. As the electrons fall back from the excited states, electromagnetic radiation may be emitted, which may be characteristic of the sample under investigation. The characteristic electromagnetic radiation (e.g. in the optical and/or infrared and/or ultraviolet range) may be separated into different frequency or wavelength components, and by a spectrometer the different frequency and/or wavelength components may be registered in terms of their intensity by a detector. From this, for example, a composition of the sample may be determined.

However, the apparatus (and/or the generated microwave) may not only be used for a spectroscopic analysis of a sample, but may also be used for other purposes. For example, the microwave may be used to heat a sample in synthesis and disintegration chemistry.

Both the antenna surrounding walls and the waveguide boundary walls may each be embodied in one-piece (or integrally), or made in plural pieces (or in a multi-piece construction). In the context of the present application, the antenna surrounding walls may also be formed as, for example, a cylindrical metal shell. A microwave, which may have been generated by the microwave source, may be radiated from the antenna into the interior space, which may be delimited by the antenna surrounding walls. Herein, the antenna may protrude through and beyond the waveguide but be surrounded by the antenna surrounding walls. In particular, the antenna surrounding walls may be placed on an edge, for example a circular edge, of a waveguide boundary wall. The waveguide boundary walls may for example have a recess (e.g. rectangular, square or circular), wherein the antenna may pass through the recess. On the edge of the recess of one of the waveguide boundary walls, for example, the antenna surrounding walls may be placed thereon so as to surround, for example, an end region of the antenna in a dome shape. The antenna surrounding walls may surround the end region of the antenna in any direction, for example axially as well as radially. The antenna surrounding walls may, for example, be partially designed as cylindrical shell surfaces (e.g. as a tube having a circular cross-sectional shape), which in particular may have a termination wall (or end wall) and/or cover surface on the end face. However, a termination wall and/or cover surface may also be missing, e.g. a tube forming the antenna surrounding walls may be open in extension of the end of the antenna. For example, the antenna surrounding walls may have a cylindrical symmetry, wherein the axis of symmetry may coincide with a longitudinal axis of the antenna.

In exemplary embodiments of the present disclosure, the antenna surrounding walls may not completely enclose the antenna, but may have one or more openings and/or drill holes. For example, one or more apertures may be provided in the surrounding walls in order to allow temperature measurements to be performed by, for example, a pyrometer and/or fibre optics (e.g. for a detection of flashovers).

The frontal surrounding wall (if any) of the antenna may e.g. have holes, e.g. be perforated. The antenna enclosure may also be designed as a long damping tube section, which may remain open at the front.

Microwave power may be extracted through an opening (or openings) (if any) in the antenna surrounding walls, e.g. by a further waveguide.

The longitudinal direction of the antenna may be understood, for example, as the direction of the greatest extension of the antenna, in particular as a longitudinal direction of an antenna rod. The antenna may be characterized by conductive material and/or dielectric material. The antenna may be electrically coupled to a part of the microwave source so as to radiate the electromagnetic energy, which may be generated in the microwave source as a microwave. The antenna as well as the microwave source may, but does not have to be, a part of the apparatus.

For example, the waveguide may have a slightly oval cross-section, or an at least approximately rectangular cross-section, or an exactly rectangular cross-section. In conventional waveguides, the ratio of a width and a height of the waveguide may be near the value of 2. However, the waveguide according to this embodiment of the present disclosure may have a reduced height compared to a conventional waveguide. For example, when the apparatus is used to generate a plasma in a plasma generation region, for example in the combustion chamber of a plasma discharge tube, the reduced height b of the waveguide may be advantageous as this reduced height may correspond or be equal to an extension along the first direction of the plasma generation region. Thus, a so-called "taper region" (a wedge-shaped and/or height-variable coupling section and/or waveguide section), in which the height of a waveguide may decrease towards the microwave applicator, may be omitted. In this way, the construction may be simplified and designed more compact. According to embodiments of the present disclosure, the waveguide boundary walls may comprise only planar waveguide boundary walls.

In this way, a compact apparatus for guiding an electromagnetic microwave may be provided, wherein the microwave may, beyond the waveguide, be used for various purposes. For example, the height b may be greater than or equal to 5 mm or 6 mm.

According to an exemplary embodiment of the present disclosure, a length (L) of the antenna may be greater than the height (b) of the waveguide, wherein in particular the height (b) of the waveguide may be substantially constant along a length of the waveguide perpendicular to the cross-sectional plane, and/or wherein in particular a cross-sectional shape and size of the waveguide may be substantially constant along a length of the waveguide perpendicular to the cross-sectional plane.

The antenna may extend through the waveguide beyond the waveguide. Thus, the antenna may be dimensioned in length according to the requirements of the microwave to be radiated. In other embodiments, for example, the length of the antenna may be less than or equal to the height of the waveguide. If the height of the waveguide is constant along a length of the waveguide (e.g. also perpendicular to the first direction and perpendicular to the second direction), the construction of the waveguide may be simplified in that the waveguide may be embodied, for example, as a cuboid-shaped waveguide. Also, a fabrication of the waveguide may be simplified, if the cross-sectional shape is substantially constant along the length of the waveguide.

According to an exemplary embodiment of the present disclosure, the two waveguide boundary walls, which may be arranged parallel to each other, may be aligned perpendicular to the first direction and located at a distance (or spaced apart) along the first direction, wherein the antenna may extend from a base region to the end region, and wherein a first one of the two waveguide boundary walls that may be arranged parallel to each other may be formed in the base region of the antenna and a second one of the two waveguide boundary walls that may be arranged parallel to each other may be formed between the base region and the end region of the antenna.

The microwave may advantageously be guided between the two waveguide boundary walls that may be arranged parallel to each other, in particular according to a desired mode. The two waveguide boundary walls that may be arranged parallel to each other may be located at a distance by the height of the waveguide. The width of the waveguide and/or the height of the waveguide may for example refer to an outer dimension or an inner dimension. The base region of the antenna may, for example, be coupled, in particular electrically connected, to the microwave source. The first one of the two waveguide boundary walls that may be arranged parallel to each other may, for example, be mounted at the housing of the microwave source. This first waveguide boundary wall may, for example, have an opening and/or recess, through which the base region of the antenna can be guided. The second one of the two waveguide boundary walls that may be arranged parallel to each other may also have a recess and/or opening, which may in particular be of the same (or different) extension and/or respectively size and/or shape as the opening in the first waveguide boundary wall, in order to also be able to guide the antenna through in a region between the base region and the end region. The antenna may thus be arranged partly (between the end region and the base region) in the waveguide, which may be enclosed and/or formed by the waveguide boundary walls, and may partly, in particular at least in the end region, be arranged inside the interior space, which may be at least partly bounded by the antenna surrounding walls.

According to an exemplary embodiment of the present disclosure, the two parallel waveguide boundary walls may be at least partially connected by at least one rounded waveguide boundary wall and/or a third and a fourth waveguide boundary wall of the waveguide boundary walls may be arranged parallel to each other, may be oriented perpendicularly on the first and the second one of the waveguide boundary walls and may connect the first waveguide boundary wall to the second waveguide boundary wall.

The cross-sectional shape of the waveguide may not be limited to an (exactly) rectangular cross-sectional shape, but may for example also be slightly oval and/or have rounded edges, which may for example have a curved section, for example a circular section. In a specific embodiment, the first, the second, the third and a fourth waveguide boundary wall may be provided, which may each be planar and may be arranged in pairs parallel to each other. Thus, a particularly simple manufacturable embodiment may be formed. In this case, the waveguide may have an exactly rectangular cross-sectional shape, wherein its width may be greater than its height.

According to an exemplary embodiment of the present disclosure, the waveguide boundary walls may extend towards a first and a second side of the antenna perpendicular to the first direction so as to form a first part and a second part of the waveguide, wherein a termination wall part may be provided on the second side, in particular oriented perpendicular to the first and second waveguide boundary walls, to terminate the second part of the waveguide. The termination wall part may serve as a short-circuiting wall at which the coupled-in microwave may be reflected. The distance of the short-circuiting wall to the antenna axis may be up to a quarter of the wavelength $\lambda$ of the microwave in the waveguide.

Due to the short-circuiting wall, a standing wave of the microwave field may be formed inside the waveguide, the wavelength of which [standing wave] may depend on the dimensions of the waveguide and on the frequency of the injected microwave. If the distance from the antenna axis to the termination wall part is $\lambda/4$, a 180° phase shift may take place at the metallic termination wall part, resulting in a constructive superposition. In a concrete example of a waveguide implementation, the distance between the antenna axis and the termination wall part (short-circuiting wall) may be 21.5 mm.

The first and the second sides (as viewed from the antenna) may extend along a third direction, which may be perpendicular to both the first direction and the second direction. The third direction may extend and/or be defined along a length of the waveguide. The microwave that may be guided in the first part of the waveguide may be guided out of the first part for further use, and may, for example, be guided to a microwave applicator, which may be formed according to the desired application.

According to an exemplary embodiment of the present disclosure, it may hold: $22>a/b>5$, and/or wherein the width of the waveguide may be between 70 mm and 120 mm, in particular between 80 mm and 110 mm, and/or wherein the height of the waveguide may be between 5 mm and 15 mm, in particular between 5 mm and 12 mm, and/or wherein a length of the waveguide perpendicular to the cross-sectional plane may be at least one quarter to one half of the wavelength of the microwave in the waveguide. Thus, depending on the application case, different geometries of width, height and length of the waveguide may be supported. In particular, the height and width of the waveguide may be selected according to an intended use of the microwave and/or a geometry of downstream components.

For these preferred a/b ratios, for example, a preferred waveguide with a=109 mm or a=86 mm is illustrated, which may have smaller than known heights, e.g. b=5 mm, 6 mm, 7 mm, 8 mm, 9 mm, 10 mm, 11 mm, 12 mm, 13 mm, 14 mm or 15 mm.

According to a further embodiment of the present disclosure, it may hold: $15>a/b>10$.

According to an exemplary embodiment of the present disclosure, at least a part of the antenna surrounding walls may be connected (e.g. directly) to at least a part of the waveguide boundary walls, and/or wherein the antenna surrounding walls may have a shell surface wall having a cylindrical section and/or planar section and a (e.g. circular or rectangular) termination wall, which may be connected, and/or wherein the antenna surrounding walls together with the antenna may act in particular as a coaxial conductor.

If at least a part of the antenna surrounding walls may be connected (in particular directly) to at least a part of the waveguide boundary walls, the construction may be simplified and one may dispense with in particular a wedge-shaped region of a waveguide used in the prior art, the cross-sectional shape and/or cross-sectional size of which may taper along a longitudinal direction. A cylindrical or substantially cylindrical shell surface wall may advantageously annularly surround a cylindrically symmetrical antenna. The end wall may close off and/or delimit the interior space, in which the antenna may be located, in the axial direction (i.e. parallel to the longitudinal direction of the antenna). The end wall may, for example, be formed as a flat, in particular circular, end wall, but may also have a complicated irregular shape. If the antenna surrounding walls together with the antenna act as a coaxial guide, an effective guidance of the microwave from the microwave source into the waveguide may be ensured.

According to an exemplary embodiment of the present disclosure, a (e.g. radial) distance between an inner surface of the cylindrical shell surface wall and an outer surface of the antenna may be substantially constant (circumferentially about the longitudinal direction of the antenna). The antenna may be surrounded by the shell surface wall at a small distance so as to also keep the dimension of the apparatus small. Measures to prevent an electrical flashover from the antenna to one of the antenna surrounding walls may be provided, such as insulation material, ceramic material, filler material made of plastic, etc. The filler material may be formed in particular by polytetrafluoroethene. Similarly, the inner distances between the outer surface of the antenna and an inner surface or the antenna surrounding walls may be suitably selected.

In an exemplary embodiment of the present disclosure, the interior space that may be delimited by the antenna surrounding walls is at least partially filled with dielectric strength increasing material, in particular plastic, especially as an inner lining on the antenna surrounding walls. In this way, interference and damage to the apparatus and/or the antenna may be avoided.

According to an exemplary embodiment of the present disclosure, the apparatus further may have a metal piston, which may be displaceable along the first direction in the interior space delimited (or bounded) by the antenna surrounding walls. The metal piston may have a cross-sectional area, which may be similar to a cross-sectional area of the interior space that may be bounded by the antenna surrounding walls. The cross-sectional area and/or cross-sectional shape of the antenna boundary walls, in particular the shell surface wall may not need to change along the first direction, but may be substantially constant. Thus, by moving the metal piston along the first direction, the height of the interior space that may be bounded by the antenna boundary walls may be adjusted, in particular to ensure an input impedance and an output impedance of the combination of the waveguide and the interior space for an optimal radiation from the antenna and injecting (or coupling-in) of the microwave into the waveguide.

According to an exemplary embodiment of the present disclosure, the antenna may have a radius that is customary for magnetron antennas of from 8 mm to 28 mm, in particular between 8 mm and 16 mm, and/or wherein the antenna may have a length of from 25 mm to 60 mm, in particular between 40 mm and 50 mm, and/or wherein the antenna may have essentially cylindrical symmetry, the axis of symmetry of which may coincide with that of the cylindrical shell surface wall. Thus, different geometries may be supported depending on the application.

According to an exemplary embodiment of the present disclosure, the antenna may have an electrical conductor and a dielectric material, in particular a ceramic material, which at least may partially surround the conductor. The ceramic material may adjust the radiation characteristics of the antenna as required and may contribute to prevent flashover.

According to an exemplary embodiment of the present disclosure, the electrical conductor may be formed as an antenna rod, wherein the ceramic material may enclose the antenna rod including an antenna rod end in a dome shape. This embodiment may be used, for example, for microwave power greater than 1.5 kW. According to an embodiment of the present disclosure, the electrical conductor may be formed as an antenna rod, and wherein the ceramic material may annularly enclose the antenna rod in a base region, further wherein a metal cap may be provided, which may be fitted on the antenna rod in an end region of the antenna rod. This embodiment may be used, for example, for microwave power of less than 1.5 kW. Thus, various embodiments of the antenna may be supported, which may be provided depending on the application case.

According to an exemplary embodiment of the present disclosure, the waveguide may be designed to guide a TE mode, in particular TE10 mode, of microwaves and/or wherein a sum of a height (H) of the shell surface wall and the height (b) of the waveguide may be greater than a length (L) of the antenna.

In particular, an end wall of the antenna boundary walls may thus be arranged relatively close to an axial end of the antenna so as to keep the apparatus compact. However, the distance between an axial end of the antenna and an end wall of the antenna boundary walls may need to be chosen so as to avoid flashovers between the antenna and the antenna boundary wall.

According to an embodiment of the present disclosure, the antenna surrounding walls and/or the waveguide boundary walls may consist of microwave reflecting materials and have, at least in part, one of the following: aluminium; brass; stainless steel, copper, silver, or alloys of the foregoing. Thus, conventionally available materials may be supported so as to enable cost-effective fabrication.

According to an exemplary embodiment of the present disclosure, the apparatus further may have a microwave source, in particular magnetron, having the antenna, which may be surrounded by the antenna surrounding walls at least partially in an end region of the antenna, and a housing, wherein at least one of the waveguide boundary walls, in particular the first waveguide boundary wall, may be at least partially attached to the housing of the microwave source. The antenna may be, for example, electrically connected to an interior of the microwave source, such as a resonator within the microwave source. Thus, conventionally available magnetrons for generating the microwave may be supported.

According to an exemplary embodiment of the present disclosure, at least one measure may be provided for the reduction of a heat transfer between the microwave source and the microwave applicator and/or the waveguide boundary walls, in particular having at least one of the following: heat trap; insulation material; cooling. Such measures may be provided individually or in any combination. When such heat transfer insulation measures are provided, the stability of the microwave source may be improved.

According to an exemplary embodiment of the present disclosure, the apparatus further may have a (cylindrical) coaxial waveguide, which may be formed by at least one cylindrical wall, in particular by two cylindrical walls that may be partially arranged one inside the other, the cylindrical axis of symmetry of which may be oriented parallel (or not parallel) to the longitudinal axis of the antenna, and which may be connected to the substantially rectangular waveguide, in particular the first part of the waveguide, in such a way as to effect a mode transformation of the microwave (from TE to TEM) that may be introduced from the substantially rectangular waveguide into the (cylindrical) coaxial waveguide, wherein a plasma may be formed by the microwave that may be guided in the (cylindrical) coaxial waveguide in a plasma generation region by ionization of a (e.g. flowing) gas (e.g. $N_2$, Ar).

The (cylindrical) coaxial waveguide may be considered as a part of a microwave applicator. Thereby, a sample may be examined spectroscopically after it may have been electronically excited by the plasma, wherein the plasma may be generated by the microwave, which may have entered into the plasma generation region through the substantially rectangular waveguide.

In particular, the height of the waveguide may be adapted to an extension of the plasma generation region, so that a reduction in or increase of a cross-sectional area of a waveguide along a longitudinal direction may be omitted.

It should be understood that features, which are individually or in any combination explained, described, provided or envisaged in relation to an apparatus for guiding a microwave may also, individually or in any combination, be applied to a method of guiding a microwave, and vice versa, according to embodiments of the present disclosure.

According to an exemplary embodiment of the present disclosure, a method of guiding an electromagnetic microwave is provided, having: allowing a microwave to proceed from an interior space into a waveguide, wherein the antenna surrounding walls delimit the interior space to at least partially enclose therein at least an end region of an antenna of a microwave source; wherein waveguide boundary walls, at least two of which are arranged parallel to each other, form the waveguide having a substantially rectangular cross-section, wherein a cross-sectional plane is defined by a first direction that extends along a longitudinal direction of the antenna and a second direction that extends perpendicular to the first direction, wherein it holds: 25>a/b>3, wherein a: is a width of the waveguide along the second direction, b: is a height of the waveguide along the first direction.

Further advantages and features of the present, disclosure will be apparent from the following exemplary description of embodiments. The disclosure is not limited to the embodiments described or illustrated.

DETAILED DESCRIPTION OF EXEMPLARY EMBODIMENTS

Figure 1:
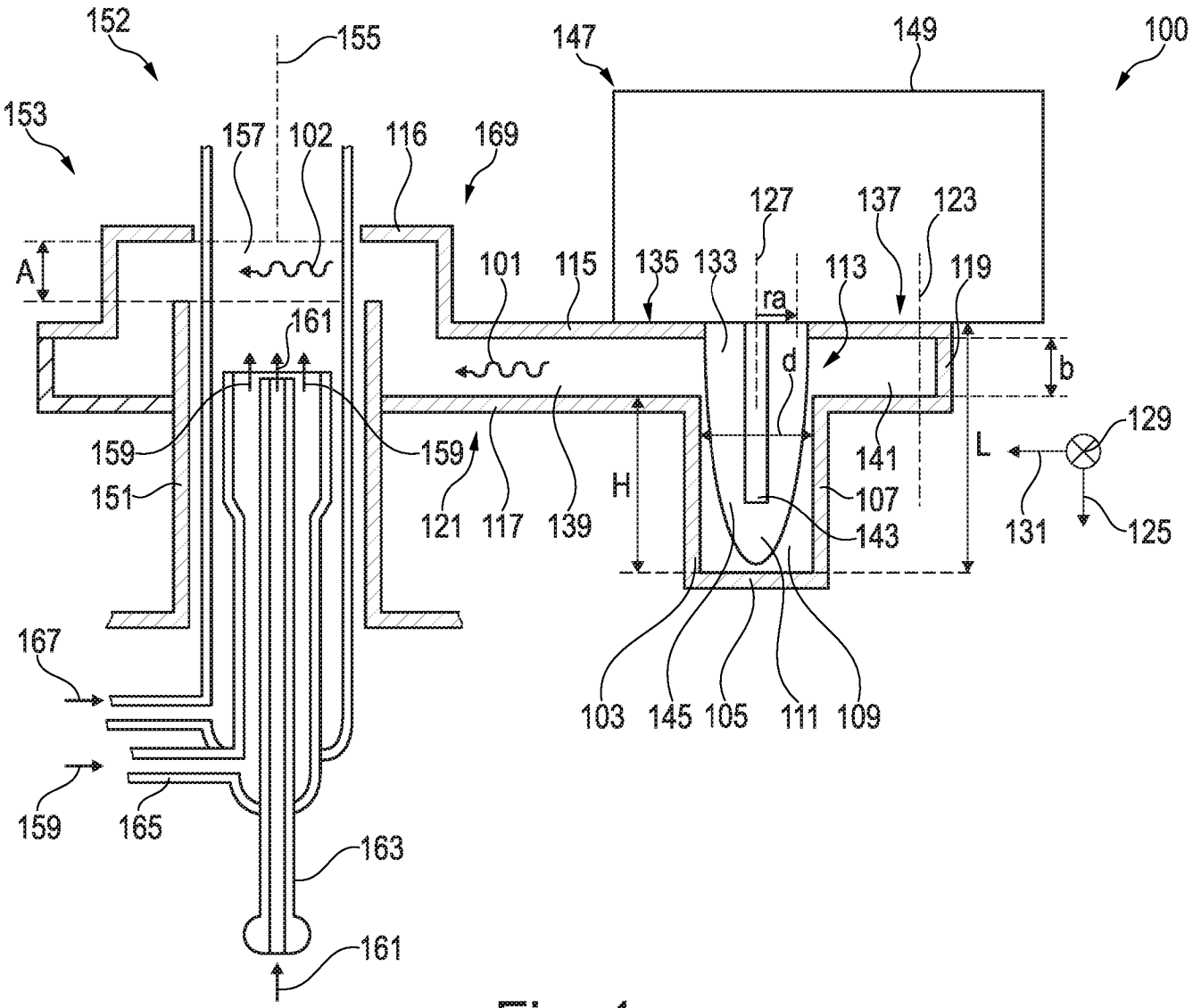
FIG. 1 illustrates in a lateral sectional view an apparatus for guiding an electromagnetic microwave according to an exemplary embodiment of the present disclosure.

Elements or structures in the drawings, which are similar in structure and/or function, are designated in the various figures by reference signs, which differ only in the first digit. The description of an element, which is not described in detail in connection with an embodiment, may be taken from a description of this corresponding element in another embodiment.

The apparatus 100 for guiding an electromagnetic microwave 101, which is schematically illustrated in a lateral sectional view in FIG. 1, may have antenna surrounding walls 103, 105, 107, which may delimit an interior space 109 in order to enclose therein at least one end region 111 of an antenna 113. The apparatus 100 further may have waveguide boundary walls 115, 117, 119 and further waveguide boundary walls that are not illustrated in FIG. 1, which may connect to each other (lying in the drawing plane) the boundary walls 115, 117 in order to thus form in the interior a waveguide 121 having a substantially rectangular cross-section (in a sectional plane perpendicular to the drawing plane of FIG. 1). Herein, a cross-sectional plane 123 may be defined by a first direction 125 that may extend along a longitudinal direction 127 of the antenna 113 and a second direction 129 that may extend perpendicular to the first direction 125 and perpendicular to the drawing plane in FIG. 1. "a" denotes a width of the waveguide 121 along the second direction 129, and "b" denotes a height of the waveguide 121 along the first direction 125. It may hold: 25>a/b>3. The width a of the waveguide 121 may thus be substantially greater than the height b of the waveguide 121. The apparatus 100 may be configured to let proceed the microwave 101 from the interior space 109 of the antenna surrounding walls 103, 105, 107 into the waveguide 121.

In an exemplary embodiment of the present disclosure that is not shown, a (through) opening may be provided (e.g. centrally) in the frontal antenna-environment wall 105 in order to arrange a temperature sensor within the interior space 109 and be able to guide a cable (e.g. optical cable) that may carry temperature measurement signals from the interior space through the opening to the exterior to a control device. Such an opening may also be provided for the exemplary embodiments illustrated in FIGS. 2, 3 and 4.

In the apparatus 100 illustrated in FIG. 1, the length L of the antenna 113 may be greater than the height b of the waveguide 121. Further, the height b of the waveguide 121 may be substantially constant along a length (along a third direction 131), which may be perpendicular to the cross-sectional plane 123. Furthermore, a cross-sectional shape and/or size of the waveguide 121 may not change along the length of the waveguide (i.e. along the third direction 131).

The waveguide boundary walls may comprise two waveguide boundary walls that may be arranged parallel to each other, namely a first waveguide boundary wall 115 and a second waveguide boundary wall 117, which may be arranged parallel to each other and are located at a distance along the first direction 125, namely by the height b of the waveguide 121. The first waveguide boundary wall 115 may extend from a base region 133 of the antenna 113, and the second waveguide boundary wall 117 may extend from a region between the base region 133 and the end region 111 of the antenna 113.

The apparatus 100 may further have a third and a fourth waveguide boundary wall, which are not shown in FIG. 1, which may also be arranged parallel to each other and may be perpendicular to the first waveguide boundary wall 115 and the second waveguide boundary wall 117 and may connect these first and second waveguide boundary walls with each other.

The waveguide boundary walls 115, 117 may extend towards a first side 135 of the antenna 113 as well as towards a second side 137 of the antenna 113 so as to form a first portion 139 and a second portion 141 of the waveguide 121. A termination wall portion 119 (e.g., acting as a short-circuiting wall/plate for the microwave) may be provided on the second side 137 in order to terminate the second portion 141 of the waveguide 121.

As can be seen from FIG. 1, the antenna surrounding walls 103, 107 may be directly or immediately connected to the second waveguide boundary wall 117. The antenna surrounding walls 103, 107 may be formed, for example, by a cylindrical shell surface wall (or cladding wall), and may thus be formed in one piece (or integrally). Further, the antenna surrounding wall 105 may form an end wall in order to close the interior space 109 in the axial direction 127 (parallel to the first direction 125). The interior space 109 may be partially or completely filled with dielectric strength-increasing material, in particular plastic.

A radius "ra" of the antenna 113 may be, for example, between 8 mm and 16 mm, and the length L of the antenna 113 may be, for example, between 40 mm to 50 mm. Furthermore, the antenna 113 may have cylindrical symmetry, wherein the axis of cylindrical symmetry may coincide with the longitudinal axis 127 of the antenna. The antenna 113 may have an electrical conductor 143 as well as a ceramic material 145 that may at least partially surround the conductor 143. In the exemplary embodiment illustrated in FIG. 1, the ceramic material 145 may surround the antenna rod 143 completely in the form of a dome.

The sum of a height H (measured from the inner side of the waveguide boundary wall 117 to the inner side of the frontal antenna surrounding wall 105) of the shell surface wall 103, 107 and the height b (measured as the distance between inner sides of the waveguide boundary walls 115, 117) of the waveguide 121 may be greater than the length L of the antenna 113.

The apparatus 100 may further have a microwave source 147, in particular a magnetron, with the antenna 113, which may be surrounded by the antenna surrounding walls 103, 107, 105 at least in the end region 111 of the antenna 113. The microwave source 147 may further have a housing 149, wherein the first waveguide surrounding wall 115 may be attached to the housing 149 of the microwave source 147. Not shown in FIG. 1 are possible measures for the reduction of a heat transfer between the microwave source 147 and the antenna surrounding walls and/or the waveguide boundary walls.

The apparatus 100 may further have a plasma applicator 152, which may have a cylindrical waveguide 153 formed by at least one cylindrical wall 151, the cylindrical axis of symmetry 155 of which may be oriented parallel to the longitudinal axis 127 of the antenna 113 (and thus also parallel to the first direction 125). The cylindrical waveguide 153 may be connected to the substantially rectangular cross-sectional waveguide 121 via connecting walls 116 so as to effect a mode transformation of the microwave 101 that may be introduced from the substantially rectangular cross-sectional waveguide 121 into the cylindrical waveguide 151.

A plasma may be formed in a plasma generation region 157 by ionization of a flowing plasma gas 167 (e.g. nitrogen or argon) by the microwave 102 that may be guided in the cylindrical waveguide 153. The sample 161 may be guided along the first direction 125 by a carrier gas (e.g. argon) in a quartz glass tube 163. The auxiliary gas 159 (e.g. nitrogen or argon) may be guided in a quartz glass guide system 165 (arranged around the quartz glass tube 163) and may keep the hot plasma away from the inner tubes 163 and 165. The flowing auxiliary gas may also serve to adjust the height of the plasma.

Figure 2:
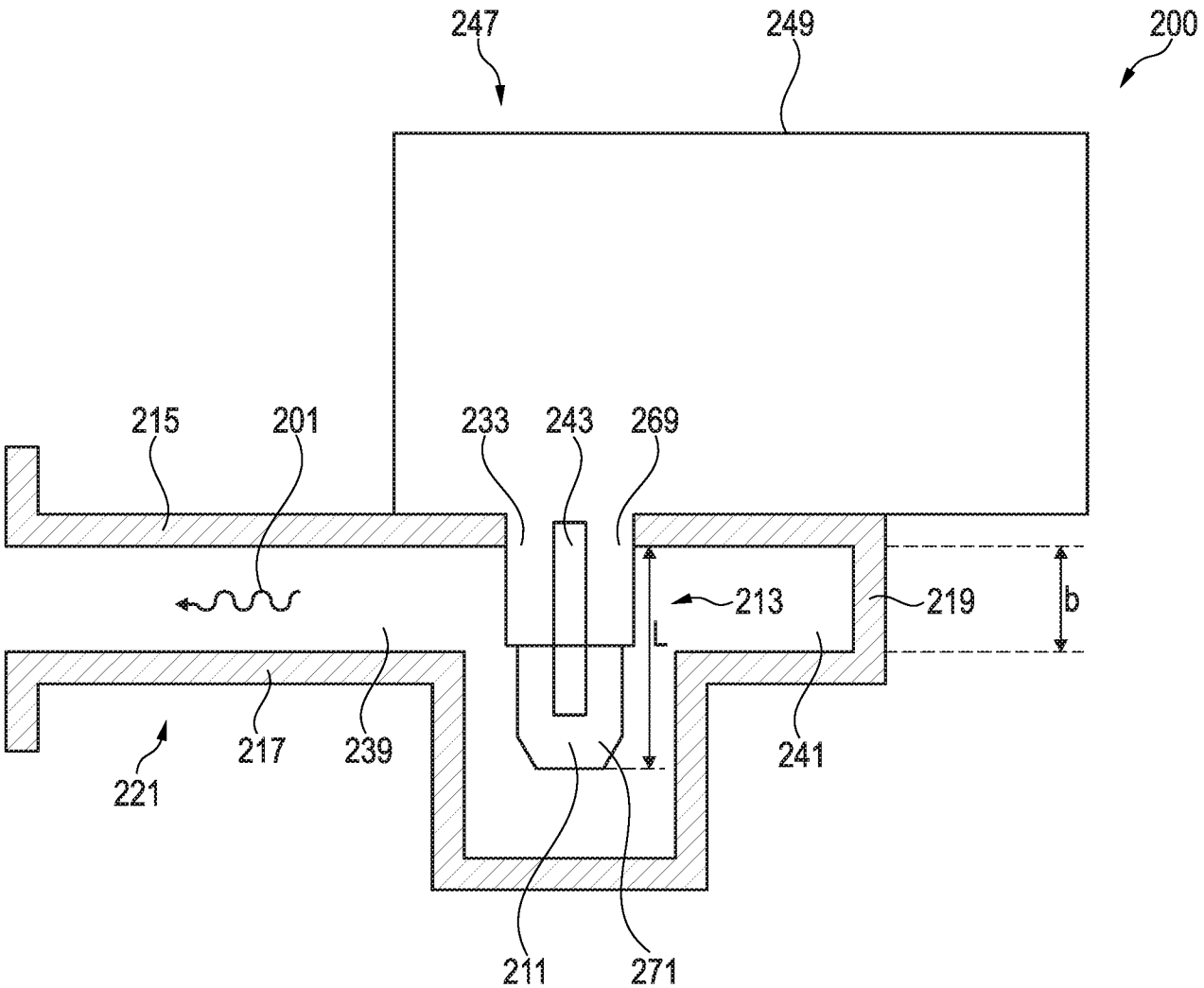
FIG. 2 illustrates in a lateral sectional view an apparatus for guiding an electromagnetic microwave according to a further exemplary embodiment of the present disclosure.

FIG. 2 illustrates in schematic sectional view an apparatus 200 according to a further exemplary embodiment of the present disclosure, wherein a plasma applicator as described in FIG. 1 with reference numeral 152 is not illustrated, but may be similar in design to the plasma applicator 152 that is illustrated in FIG. 1.

The apparatus 200, which is illustrated in FIG. 2, may show similarities to the apparatus 100 that is illustrated in FIG. 1, wherein, however, the antenna 213 may be designed differently from the antenna 113 illustrated in FIG. 1. The antenna 213 of the apparatus 200 illustrated in FIG. 2 may also have an antenna rod 243, but may not have a ceramic dome 145 like the antenna 113 illustrated in FIG. 1. Instead, the antenna 213 may have a ceramic ring 269 in the base region 233 in order to annularly surround, in particular embed, the antenna rod 243 in this base region 233. Above the base region 233 towards the end region 211, a metal cap 271 may befitted on the antenna rod 243. In this region, the antenna 213 may not comprise any ceramic.

Figure 3:
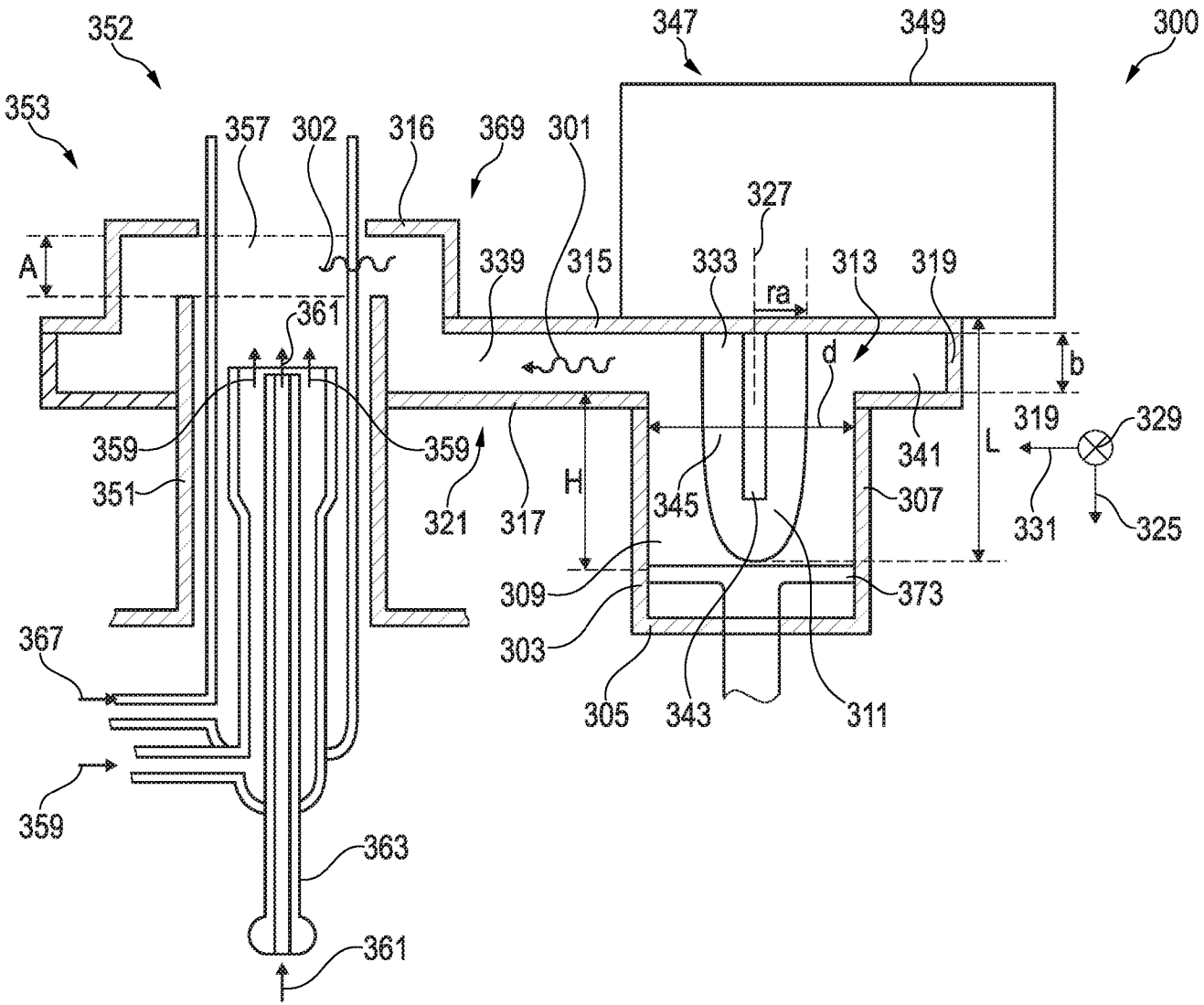
FIG. 3 illustrates in a lateral sectional view an apparatus for guiding an electromagnetic microwave according to a still further exemplary embodiment of the present disclosure.

FIG. 3 illustrates in schematic cross-sectional view a further apparatus 300 according to an exemplary embodiment of the present disclosure, which may have similarities with the apparatus 100 illustrated in FIG. 1. However, unlike the apparatus 100 illustrated in FIG. 1, the apparatus 300 illustrated in FIG. 3 may further have a metal piston 373, which may be displaceable along the first direction 325 in the interior space 309 that may be delimited by the antenna surrounding walls 303, 305, 307, so as to thereby adjust the height H of this interior space 309. Thus, a more effective power transmission of the microwave from the antenna 313 into the substantially rectangular cross-sectional waveguide 321 may be effected.

Figure 4:
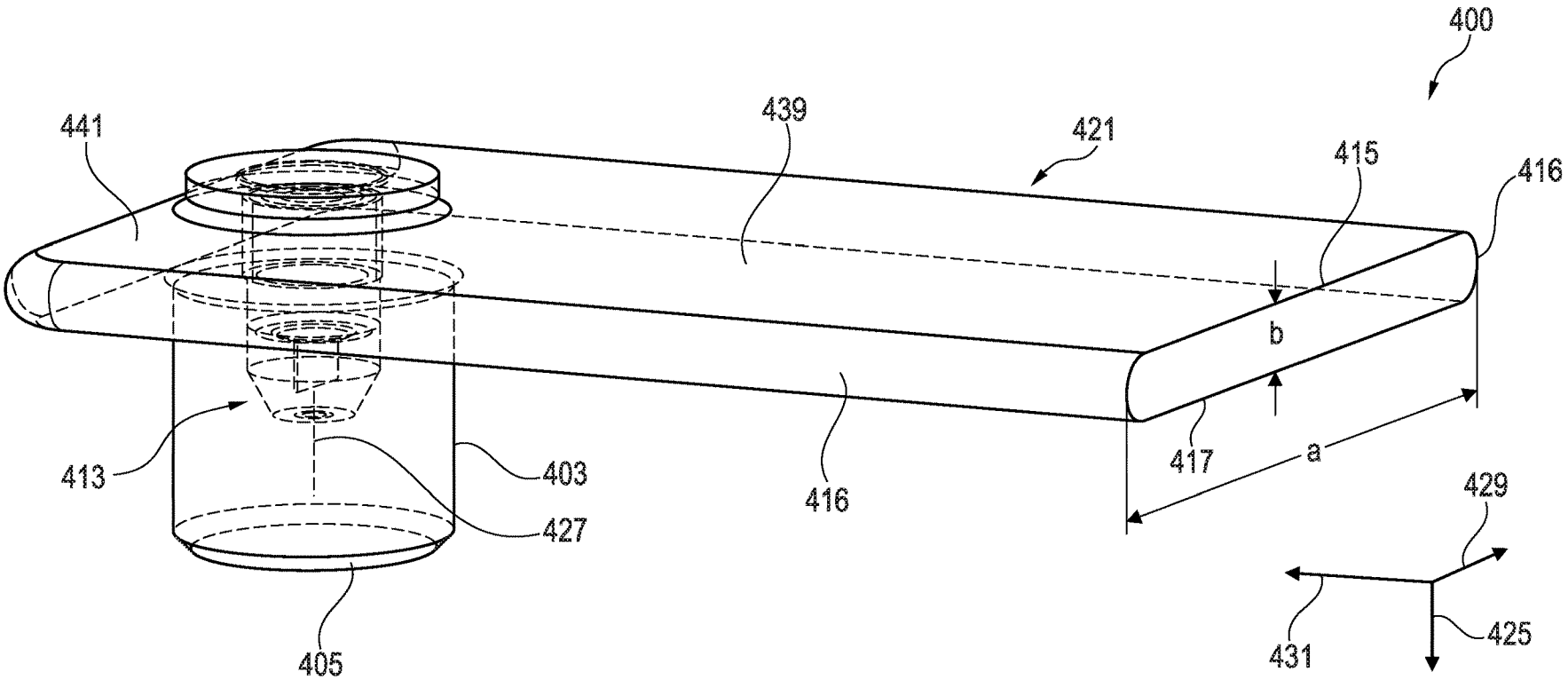
FIG. 4 illustrates in a schematic, perspective view an apparatus for guiding an electromagnetic microwave according to an exemplary embodiment of the present disclosure.

FIG. 4 illustrates in schematic perspective view an apparatus 400 for guiding a microwave according to a further exemplary embodiment of the present disclosure. The substantially rectangular cross-sectional waveguide 421 again may have a first waveguide boundary wall 415 and a second waveguide boundary wall 417, which may be parallel to each other and may be located at a distance in the first direction 425. However, these parallel waveguide boundary walls 415, 417 may be connected by rounded (i.e. non-planar) waveguide boundary walls 416. In FIG. 4, the cylindrical antenna perimeter wall 403 may be recognized, as well as the end wall 405, which may terminate the cylindrical shell surface wall 403 in the axial direction, i.e. along the longitudinal direction 427 of the antenna 413.

The waveguide injecting unit (or waveguide coupling-in unit) (also referred to as an apparatus for guiding an electromagnetic microwave) may allow it to be used directly in conjunction with microwave applicators having a low waveguide height without the need for additional bulky components, such as for example "tapers". Heat fluxes from the microwave applicator and/or the waveguide injector may be limited by appropriate insulation measures. The apparatus for guiding an electromagnetic microwave may be used, for example, in analytical chemistry in the elemental analysis. Herein, a microwave-induced plasma may be used in a corresponding microwave applicator, for example microwave applicator 152. The elemental analysis may typically place high demands on a plasma excitation source in terms of the stability of the radiation power that maintains the plasma. Herein, the parameter power output stability may be specified for the high-frequency generators, wherein the values to be fulfilled may be <0.1% of the currently generated power. The reproducible generation of ions by the plasma with unchanged operating parameters (high-frequency power, gas flows, etc.) over a sufficiently long period of time (several hours) may be essential for the analysis method so that the relationship that may be established by calibration at a point in time between a number of photons of an element of a certain concentration generated by the plasma excitation at an element-specific wavelength may always lead to the same number of collected count rates at the respective detector pixels in a spectrometer.

By taking appropriate thermal insulation measures between the plasma source and the waveguide boundary walls, the power stability may be achieved as desired. The short term stability may also be improved by these measures. Exemplary embodiments of the present disclosure may have as an advantage a compactness of a waveguide injecting unit, wherein the power stability of the generated radio frequency radiation may be fulfilled. The powers of the plasma source may be of the order of magnitude of a few kilowatts and may lead to temperature increases in subordinated or related components. The thermal insulation measures may reduce these temperature heat fluxes. According to an exemplary embodiment of the present disclosure, the magnetron or more generally the microwave source may be cooled by an air cooling and/or a water cooling.

Conventionally, for a microwave frequency of, for example, 2.45 GHz, waveguides may have a standard waveguide width a of 86.36 mm and a waveguide height b of 43.18 mm. Conventional antennas of magnetrons may have a height of from about 26 mm to about 47 mm and may protrude into conventional waveguide injecting units without protruding beyond them. Conventionally, the matching of the waveguide cross-section b (i.e. the height) for the actual plasma applicator (in which the height may be, for example, 8 mm) may require a waveguide standard (having a height of 43.18 mm) with a low-reflection continuous transition over multiples of half wavelengths (typically 1 to 3 depending on the quality of matching sought) in the direction of propagation for a given waveguide width a. Thus, conventionally "tapers" may be used to match the standard waveguide height of about 43 mm to the height of about 8 mm of a typical plasma applicator. This may involve a great deal of design effort. The larger mass and the larger volume of the conventional "taper" of the wave applicator may result in longer settling times, which may be why a waiting time until the specified power stability is achieved may be relatively high.

Therefore, the waveguide injecting unit (also referred to as a waveguide launcher and/or as an apparatus for guiding an electromagnetic microwave) may have a waveguide with reduced height, typically about 8 mm, wherein the width may remain at conventional e.g. about 86 mm.

In an exemplary embodiment, the microwave radiation may be coupled into the waveguide from the antenna at the ceramic ring of the magnetron. The redesign of the waveguide injecting unit in the required reduced waveguide height may save large additional efforts in the form of components such as tapers in connection with standard launchers. Thus, the compactness of the apparatus or the waveguide injecting unit may be achieved. Furthermore, a lower proportion of wall current losses may be achieved due to the smaller total metallic envelope of the waveguide surrounding the microwave cavity. The apparatus may be connected to a magnetron, for example, via a flange.

The apparatus for guiding an electromagnetic wave may be used with a magnetron, the antenna of which may consist of a ceramic ring and a metal cap as well as designs above 1.5 kW power with antenna rod and ceramic dome. A preferred exemplary embodiment may have a complete or partial filling of the microwave cavity with dielectric materials other than air.

A thermal decoupling and/or a reduction of the heat flow from the plasma applicator or to the waveguide injecting unit and/or to the apparatus for guiding an electromagnetic microwave and/or to the magnetron and its magnet system may be achieved by reducing the cross-sections that may be relevant for the heat conduction, changing materials in sections (material with significantly poorer thermal conductivity) and/or heat traps, filled with air or plastic, preferably on the flange side to the magnetron by passive design measures. An air and/or a water cooling may be provided for the magnetron in order to reduce temperature changes at the ferrite magnets.

For example, the air spaces under the magnetron may be provided between the magnetron and the waveguide boundary walls, these may for example be milled into the waveguide boundary walls. In other exemplary embodiments, an interface for directional couplers may be provided (for measurement purposes, control or regulation). Furthermore, the waveguide may be cooled, for example with liquid cooling, e.g. cooling channels may be provided in the waveguide boundary walls. Parts of the waveguide boundary walls and/or of the antenna surrounding walls may also have cooling fins in order to dissipate a part of the thermal energy to the ambient air.

A use of insulating dielectric materials may be possible in the waveguide for increasing the dielectric strength and this the possibility of further reduction of the waveguide height b. For example, an applicator for microwave disintegration, or for microwave synthesis, may further be provided as a microwave applicator.

Exemplary embodiments of the present disclosure disclose a waveguide concept for injecting (or coupling-in) and transmitting microwave radiation of a magnetron into the combustion chamber of a plasma torch. The waveguide concept and/or the waveguide injecting unit and/or the apparatus for guiding an electromagnetic microwave may find application in optical emission spectrometry with microwave-induced plasma MIP-OES in the field of trace analysis. Possible applications may be microwave digestion reactors, microwave synthesis reactors.

The microwave power introduction into a plasma combustion chamber of a discharge tube of a microwave-induced plasma device may have a high power. The plasma may be generated at sufficiently nigh temperature and density, so as to perform direct analysis of aqueous samples. In this regard, a location with sufficiently high microwave field strength within the fused silica tube and/or within the plasma generation region or within the cylindrical waveguide may form a microwave plasma generation region. Common plasma discharge tubes, which may also be called plasma flares, may have a short overall construction length between the gas connections for cooling gas and auxiliary gas and the actual combustion chamber of the plasma. The construction lengths of the plasma flares may be, for example, 140 mm. The axial construction length of the plasma flare in the region of the plasma generation area may be approximately between 6 and 10 mm. In order to concentrate a sufficiently high field strength of the microwave in the microwave plasma generation region, a waveguide guiding the microwave may have approximately these height dimensions. In the prior art, this height reduction may have been accomplished by introducing so-called "tapers", i.e. wedge-shaped and/or cone-shaped waveguides. However, this may lead to an increased complexity and size of the apparatus.

According to an exemplary embodiment of the present disclosure, a waveguide section with variable cross-sectional area may be avoided. Instead, a single waveguide (e.g., having invariable cross-sectional area) with reduced height may be used (e.g., 8 mm height, e.g., 86 mm width), and the microwave power may be coupled directly into this waveguide. The redesign of the waveguide injecting unit therefore may save disproportionate great efforts in terms of components such as tapers and standard launchers. The proposed waveguide may work both with magnetrons, whose antenna consists of ceramic and metal cap, and with exemplary embodiments above 1.5 kW with antenna rod and ceramic dome.

An end of the antenna protruding in the waveguide may be surrounded by a metal sheath (also referred to as antenna surrounding walls) according to an exemplary embodiment of the present disclosure. The waveguide injecting unit therefore may have an opening in the upper region for coupling the magnetron antenna. The antenna may protrude above the waveguide and may preferably be surrounded by a cylindrical metal sheath. The metal sheath forms, with the metallic antenna of the magnetron, a coaxial conductor up to the end of the antenna in cross-section, and thus conditions may be provided, which may enable wave propagation. The metal sheath may preferably be cylindrical, but it may also be rectangular. The inner diameter d and the height H of the metal sheath may be designed suitably for the use of magnetrons having a ceramic antenna. Thus, a minimum height H of the metal sheath may be given by the antenna length L minus the waveguide height b. The inner diameter d may be sufficiently large to surround the antenna. The diameter of the antenna may be about 28 mm and the length of the ceramic antenna may typically be 47 mm.

When using magnetrons up to 1.5 kW, the dimensions of the antenna may also be smaller. In this exemplary embodiment, preferably the microwave radiation may be coupled directly into the launcher at the ceramic ring of the magnetron. The metal sheath may be filled or lined with microwave-suitable plastics such as PTFE so as to increase an electrical dielectric strength. A ceramic dome, if present, on an antenna rod may improve an insulation, thus preventing flashovers. If a metal plunger is provided to vary the size of the interior space formed by the antenna surrounding walls, adjustment of the impedance may be achieved to thus effectively couple out the microwave into the waveguide.

The length of the waveguide may, for example, be a quarter to a half of the waveguide wavelength of the microwave. Typically, after passing through this section, a base mode (or fundamental mode) may be formed in the rectangular waveguide section. For a microwave having a frequency of 2.45 GHz, the waveguide width may amount to a=85 mm and waveguide height b=8 mm. The apparatus for guiding an electromagnetic microwave may transform the mode of the generator output of the microwave source to the mode of the waveguide. The antenna surrounding walls may be formed integrally or as plural parts with the waveguide boundary walls. Exemplary embodiments of the present disclosure may provide a waveguide injecting unit having a reduced height and having an aperture for direct injecting of microwave power via a coupling pin/antenna that may project beyond the waveguide and at least partially surrounded by a cylindrical metal shell.

It is noted that space-related terms, such as for example "front" and "back", "top" and "bottom", "left" and "right", etc., are used to describe the relationship of one element to another element or elements, as illustrated in the figures. Accordingly, the space-related terms may apply to orientations, which are different from the orientations that are illustrated in the Figures.

It is noted that the term "have" (or "comprise") does not exclude other elements, and that the "a" or "an" does not exclude a plurality. Also, elements described in connection with different embodiments may be combined. It should also be noted that reference numerals in the claims should not be construed as limiting the scope of the claims.

The invention claimed is:

1. Apparatus for guiding an electromagnetic microwave, having:

antenna surrounding walls, which at least partially define an interior space so as to surround therein at least an end region of an antenna of a microwave source;

waveguide boundary walls, at least two of which are arranged parallel to each other, wherein the waveguide boundary walls form a waveguide having a cross-section shape, wherein a cross-sectional plane is defined by a first direction that extends along a longitudinal direction of the antenna and a second direction that extends perpendicularly to the first direction, wherein the two parallel waveguide boundary walls are aligned perpendicular to the first direction and are located at a distance along the first direction, wherein said antenna extends from a base region to the end region, wherein a first one of the two waveguide boundary walls that are arranged in parallel extends at the base region, wherein a second one of said two waveguide boundary walls that are arranged in parallel extends between the base region and the end region of said antenna, wherein it holds: 25>a/b>3, wherein a: is a width of the waveguide along the second direction, b: a height of the waveguide along the first direction, wherein the apparatus is designed to let proceed a microwave from the interior space of the antenna surrounding walls into the waveguide, wherein one of the following holds:

the two parallel waveguide boundary walls are at least partially connected by at least one rounded off waveguide boundary wall;

a third and a fourth waveguide boundary wall of the waveguide boundary walls are arranged parallel to each other, are oriented perpendicularly on the first one and the second one of the waveguide boundary walls, and connect the first waveguide boundary wall to the second waveguide boundary wall such that the cross-section shape of the waveguide is rectangular.

2. Apparatus according to claim 1, wherein the antenna surrounding walls surround the end region of the antenna laterally annularly as well as frontally.

3. Apparatus according to claim 1, wherein a length of the antenna is greater than the height of the waveguide, wherein in particular the height of the waveguide is constant along a length of the waveguide perpendicular to the cross-sectional plane, and/or wherein in particular a cross-sectional shape and size of the waveguide is constant along a length of the waveguide perpendicular to the cross-sectional plane.

4. Apparatus according to claim 1, wherein the waveguide boundary walls extend towards a first and a second side of the antenna perpendicular to the first direction so as to form a first portion and a second portion of the waveguide, wherein a termination wall portion is provided on the second side so as to terminate the second portion of the waveguide.

5. Apparatus according to claim 1, wherein it holds: 22>a/b>5, and/or wherein the width of the waveguide is from 70 mm to 110 mm, and/or wherein the height of the waveguide is from 5 mm to 15 mm, and/or wherein a length of the waveguide perpendicular to the cross-sectional plane is at least a quarter to a half of the wavelength of the microwave in the waveguide.

6. Apparatus according to claim 1, wherein at least a portion of the antenna surrounding walls is connected to at least a portion of the waveguide boundary walls, and/or wherein the antenna surrounding walls comprise a lateral surface wall that has a cylindrical portion and/or planar portions, and an end wall, which are connected, and/or wherein the antenna surrounding walls together with the antenna act as a coaxial conductor.

7. Apparatus according to claim 1, wherein the interior space that is delimited by the antenna surrounding walls is at least partially filled with dielectric strength increasing material.

8. Apparatus according to claim 1, further having:

a metal piston, which is displaceable along the first direction in the inner space delimited by the antenna surrounding walls.

9. Apparatus according to claim 1, wherein the antenna has a radius of from 8 mm to 28 mm, and/or wherein the antenna has a length of from 30 mm to 60 mm, and/or wherein the antenna has cylindrical symmetry, the axis of symmetry of which coincides with that of the cylindrical lateral surface wall.

10. Apparatus according to claim 1, wherein the antenna has an electrical conductor and a dielectric medium, which at least partially surrounds the conductor.

11. Apparatus according to claim 10, wherein the electrical conductor is formed as an antenna rod, and wherein the ceramic material dome-shapedly surrounds the antenna rod including an antenna rod end.

12. Apparatus according to claim 10, wherein the electrical conductor is formed as an antenna rod, and wherein the ceramic material annularly surrounds the antenna rod in a base region, further wherein a metal cap is provided, which is fitted on the antenna rod in an end region of the antenna rod.

13. Apparatus according to claim 1, wherein the waveguide is designed to guide a TE mode, in particular TE10 mode, of microwaves and/or wherein a sum of a height of the lateral surface wall and the height of the waveguide is greater than a length of the antenna.

14. Apparatus according to claim 1, wherein the antenna surrounding walls and/or the waveguide boundary walls comprise, at least in part, any one of the following: aluminium; brass; stainless steel, copper, silver, or alloys of any of the foregoing.

15. Apparatus according to claim 1, further having:

a microwave source, having the antenna that is surrounded by said antenna surrounding walls at least in an end region of the antenna, and a housing, wherein at least one of the waveguide boundary walls is at least partially attached to the housing of the microwave source.

16. Apparatus according to claim 15, wherein at least one measure is provided for reducing a heat transfer between the microwave source and the antenna surrounding walls and/or the waveguide boundary walls, having at least one of the following:

heat trap;

insulation material; or cooling.

17. Apparatus according to claim 1, wherein the cross-sectional shape of the waveguide is rectangular, the apparatus further having:

a cylindrical coaxial waveguide that is formed by at least one cylindrical wall, which waveguide is connected to the rectangular cross-sectional waveguide in such a way as to effect a mode transformation of the microwave that is introduced from the rectangular cross-sectional waveguide into the cylindrical coaxial waveguide, wherein a plasma flare can be formed in a plasma generation region by ionization of a gas by the microwave that is guided in the cylindrical waveguide.

18. A method of guiding an electromagnetic microwave, having:

allowing a microwave to proceed from an interior space into a waveguide, wherein antenna surrounding walls delimit the interior space so as to surround therein at least an end region of an antenna of a microwave source;

wherein waveguide boundary walls, at least two of which are arranged parallel to each other, form the waveguide having a cross-section shape, wherein a cross-sectional plane is defined by a first direction that extends along a longitudinal direction of the antenna and a second direction that extends perpendicular to the first direction, wherein the two parallel waveguide boundary walls are aligned perpendicular to the first direction and are located at a distance along the first direction, wherein said antenna extends from a base region to the end region, wherein a first one of the two waveguide boundary walls that are arranged in parallel extends at the base region, wherein a second one of said two waveguide boundary walls that are arranged in parallel extends between the base region and the end region of said antenna, wherein it holds: $25>a/b>3$, wherein a: is a width of the waveguide along the second direction, b: is a height of the waveguide along the first direction, wherein one of the following holds:

the two parallel waveguide boundary walls are at least partially connected by at least one rounded off waveguide boundary wall;

a third and a fourth waveguide boundary wall of the waveguide boundary walls are arranged parallel to each other, are oriented perpendicularly on the first one and the second one of the waveguide boundary walls, and connect the first waveguide boundary wall to the second waveguide boundary wall such that the cross-section shape of the waveguide is rectangular.

* * * * *